US009702101B1

(12) United States Patent
Ficks

(10) Patent No.: US 9,702,101 B1
(45) Date of Patent: Jul. 11, 2017

(54) VACUUM HOSE HANDLING AND SAFETY VACUUM RELEASE SYSTEM

(71) Applicant: David Ficks, Cincinnati, OH (US)

(72) Inventor: David Ficks, Cincinnati, OH (US)

( * ) Notice: Subject to any disclaimer, the term of this patent is extended or adjusted under 35 U.S.C. 154(b) by 218 days.

(21) Appl. No.: 14/607,303

(22) Filed: Jan. 28, 2015

Related U.S. Application Data

(63) Continuation-in-part of application No. 13/553,032, filed on Jul. 19, 2012, now abandoned.

(60) Provisional application No. 61/509,707, filed on Jul. 20, 2011.

(51) Int. Cl.

| | |
|---|---|
| ***E02F 3/88*** | (2006.01) |
| ***E01H 1/08*** | (2006.01) |
| *A47L 9/00* | (2006.01) |
| *A47L 9/28* | (2006.01) |
| *E02F 3/90* | (2006.01) |

(52) U.S. Cl.
CPC ..... *E01H 1/0836* (2013.01); *A47L 9/0072* (2013.01); *A47L 9/2889* (2013.01); *E02F 3/88* (2013.01); *E02F 3/902* (2013.01)

(58) Field of Classification Search
CPC ..... A47L 9/0072; A47L 9/2889; E02F 3/88; E02F 3/902
USPC ..... 15/421, 246.2, 354, 410, 419
See application file for complete search history.

(56) References Cited

U.S. PATENT DOCUMENTS 2,096,595 A * 10/1937 Sanford ..... E02F 3/902 15/421
2,826,836 A * 3/1958 Hoffman ..... E02F 3/902 37/311
2,970,865 A 2/1961 Finnegan et al.
2,978,733 A * 4/1961 Wahlborg ..... A47L 9/0072 15/421
3,048,876 A * 8/1962 Kemnitz ..... A47L 11/30 15/321
3,277,512 A * 10/1966 Waters ..... A47L 5/32 15/337
3,781,941 A * 1/1974 MacFarland ..... A47L 9/242 15/339
3,913,607 A * 10/1975 Price ..... A61M 16/12 128/205.11
4,776,731 A 10/1988 Briggs et al.
4,881,855 A 11/1989 Rempel et al.
4,961,245 A * 10/1990 Barnes, Jr. ..... A47L 9/0072 15/339
5,356,115 A * 10/1994 Helmick ..... F16K 31/465 15/421
5,665,248 A * 9/1997 McKiddy, II ..... E04H 4/1218 15/421

(Continued)

FOREIGN PATENT DOCUMENTS

GB 525744 A * 9/1940 ..... E02F 3/902

*Primary Examiner* — Michael R Reid
*Assistant Examiner* — Christopher Ballman
(74) *Attorney, Agent, or Firm* — RG Patent Consulting, LLC; Rachel Gilboy

(57) ABSTRACT

A vacuum hose handling and safety vacuum release system, a tubular column attachable to an industrial vacuum hose end having a long handle and a short T-handle positioned at right angles to each other that will allow a user to strategically place the metallic vacuum tube conveniently and easily to vacuum debris in a safe manner. The tube has at least one bypass orifice that the user can open to reduce or eliminate the suction at the nozzle via a lever pivotally located adjacent the T-handle.

1 Claim, 7 Drawing Sheets

(56) References Cited

U.S. PATENT DOCUMENTS

| | | | | |
|---|---|---|---|---|
| 7,891,050 | B2 | 2/2011 | Liddell | |
| 2003/0126697 | A1 | 7/2003 | Firdaus et al. | |
| 2004/0055637 | A1* | 3/2004 | Bossom | F16K 17/28<br>137/114 |
| 2006/0191098 | A1 | 8/2006 | Hiebert | |
| 2007/0199605 | A1* | 8/2007 | Pears | A47L 9/0072<br>137/893 |
| 2007/0226945 | A1* | 10/2007 | McIntyre | A47L 5/365<br>15/327.6 |

* cited by examiner

VACUUM HOSE HANDLING AND SAFETY VACUUM RELEASE SYSTEM

CROSS-REFERENCE TO RELATED APPLICATION

The present application is a Continuation-in-Part (CIP) related to and claims priority from prior provisional application Ser. No. 61/509,707 filed Jul. 20, 2011 and pending non-provisional application Ser. No. 13/553,032 filed Jul. 19, 2012 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of vacuum hose attachments, and more specifically relates to a vacuum hose handling and safety vacuum release system.

2. Description of the Related Art

Industrial strength vacuums are used for a wide variety of tasks in modern industry. Most often, the vacuums are vehicle or trailer mounted so that they are somewhat portable. Some industrial uses of large vacuums include: clearing sumps, canals, tunnels, and below grade containments of liquids, solids, sand, or debris; vacuum excavating for utilities; clearing underground wastewater collection system piping; and transferring small solids, such as grains, from one container to the next. A vacuum works ideally when a piece of heavy equipment isn't built or shaped properly for the task. Vacuum excavating for utilities is often very valuable when congestion with other close proximity utilities is a problem. When excavating with a backhoe, the risk of damaging other utilities increases exponentially which is desirable to avoid.

When an underground utility emergency occurs, Blue Stake (or Call Before you Dig) is normally contacted. Blue Stake is a center for controlling underground excavations in order to protect underground infrastructure and for increasing the safety of the individuals performing the excavations. Blue Stake calls each utility company that is known to have utilities in the area so they can come out and locate and mark their own buried utilities using paint markings at the location of the emergency. This hopefully allows the particular utility company having the emergency to excavate safely around the other utilities. Underground gas and electric lines damaged by unsuspecting operators during excavations utilizing backhoes and shovels have resulted in many fatalities. On the other hand, industrial vacuums, also called "vactors," can excavate utilities in a non-destructive way. The utilities are much less likely to be damaged when excavating in this way and excavations can begin as soon as the vactor truck arrives. During a utility emergency, Blue Stake response can be very slow.

While vacuum excavation is much safer and more convenient than using bucket excavation type heavy equipment, it poses its own set of safety problems. Industrial vacuum hoses generally range in diameter from 3 inches to 12 inches and can have an entry air speed of 400 mph or more with a negative pressure of up to 340 psi. When workers are working in close proximity (as often happens when performing utility excavations) the danger to individuals that accidently get too close to the suction end of the vacuum hose is extreme. Vactor trucks are usually equipped with a bypass valve that will greatly reduce or nearly eliminate the vacuum at the nozzle in the event of such an emergency, or when too large of debris plug the end of the nozzle and it has to be manually removed. The bypass is located near the operator controls on the truck, which is too far and results in too much time expiring before the bypass can be opened if an emergency occurs. Instantaneous vacuum bypass cannot reliably be achieved when relaying commands by word of mouth in a noisy environment. The person directing the end of the vacuum hose must be able to quickly perform the vacuum bypass. A quicker and safer solution than is currently available is needed.

Various attempts have been made to solve the above-mentioned problems such as those found in U.S. Pat. and Pubs. Nos. 4,881,855; 2,970,865; 4,776,731; 2006/0191098; 2003/0126697; and 7,891,050. This prior art is representative of industrial vacuum nozzles. None of the above inventions and patents, taken either singly or in combination, is seen to describe the invention as claimed.

Ideally, an industrial vacuum nozzle should allow speedy emergency vacuum bypass, and yet, would operate reliably and be manufactured at a modest expense. Thus, a need exists for a reliable vacuum hose handling and safety vacuum release system to provide a safety vacuum release for a vacuum nozzle operator operable by the operator, and to avoid the above-mentioned problems.

BRIEF SUMMARY OF THE INVENTION

In view of the foregoing disadvantages inherent in the known vacuum nozzle art, the present invention provides a novel vacuum hose handling and safety vacuum release system. The general purpose of the present invention, which will be described subsequently in greater detail, is to provide a safety vacuum release for a vacuum nozzle operator.

Generally speaking, the vacuum hose handling and safety vacuum release system (Safety Shutter Vacuum Nozzle) is a tubular column attachable to an industrial vacuum hose end having a long handle and a short T-handle positioned at right angles to each other that will allow a user to place the vacuum tube conveniently and easily on the materials to be vacuumed. The tube has at least one bypass orifice that the user can (at will) open to reduce or eliminate the suction at the nozzle via a lever pivotally located adjacent the T-handle.

In greater detail now, the vacuum hose handling and safety vacuum release system as disclosed herein in a preferred embodiment comprises a vacuum hose handling assembly having a column comprising a proximate end and a distal end, a vacuum hose securer, at least one handle having a first end with a grip, a second end, a vacuum release lever, a vacuum release linkage, a vacuum release orifice stopper, a removable suction end, and a suction end securer band. The proximate end of the column of the vacuum hose handling assembly is removably attached to a vacuum hose end of a vacuum source. The handle is removably attached preferably longitudinally to an exterior of the column such that the first end of the handle comprising the grip is adjacent the flexible vacuum hose, the grip providing a gripper for a user to hold and manipulate the vacuum hose handling assembly from the proximate end. The handle preferably comprises a contoured-bend along its length to facilitate the user standing in an upright orientation when using the vacuum hose handling assembly to remove the material from a ground surface.

The vacuum release lever comprises a safety vacuum-release-handle. The handle may comprise a T-handle; the T-handle positioned at a right angle to the handle and located on an opposite side to the vacuum release lever such that the vacuum hose handling assembly is effectively balanced when held and manipulated. The vacuum release lever rotates about a centerline axis perpendicular to the handle, the vacuum release linkage running substantially parallel to the handle. The vacuum release lever may also comprise an end-loop in some embodiments. The second end of the handle is affixed to the distal end of the column to steady the column while in use.

The vacuum hose securer comprises a clamp for securing the flexible vacuum hose to the proximate end of the column, which is tubular in preferred embodiments. The column may comprise a taper to prevent the vacuum hose end from becoming plugged by oversized pieces of the material. The taper comprises a larger circumference at the proximate end than at the distal end of the column. The proximate end of the column comprises a landing such that the vacuum hose is only able to be inserted over the proximate end of the column a specified distance. The vacuum release lever is connected to the vacuum release orifice stopper via the vacuum release linkage (or other suitably equivalent means). The vacuum release linkage is able to move the vacuum release orifice stopper between open and closed positions in relation to the column to provide vacuum and alternately to release the vacuum. The safety-release-handle can regulate air flow and the vacuum via the vacuum release linkage. The safety-release-handle comprises an open condition for the vacuum release orifice stopper when the safety-release-handle is in the rearward location. The safety-release-handle comprises a closed condition for the vacuum release orifice stopper when the safety-release-handle is in the forward location. The operator is thus able to manipulate the handle to open and close the vacuum to the ambient environment at will and repeatedly.

The vacuum release linkage in certain embodiment may comprise a rigid rod such that the vacuum release lever is able to push or pull (depending on where the pivot is located on the shutter) the vacuum release orifice stopper into the open condition. The vacuum release linkage then is therefore also able to push the vacuum release orifice stopper to close the at least one orifice located in the column, which is a closed condition. The vacuum release orifice stopper maintains the vacuum in the column when closed and allows airflow through the nozzle, and releases the vacuum at the nozzle when opened, the vacuum release orifice stopper slideably (or other means) covers at least one orifice located in the column. The vacuum release orifice stopper may comprise a planar gate in some embodiments and the vacuum release orifice stopper may comprise an arcuate slide cover in certain embodiments; other embodiments may not slide. The removable suction end is removably coupleable to the distal end of the column via the suction end securer band. The vacuum hose handling assembly is useful for controllably vacuum-sucking material into a vacuum hose connected to a vacuum source; the vacuum controllable via the user such as to virtually eliminate a need for the user to manually extract items of the material when the distal end of the column becomes clogged.

A method of use for a vacuum hose handling and safety vacuum release system may comprise the steps of: gripping a handle and a t-handle of a vacuum hose handling assembly, guiding the vacuum hose handling assembly to a debris to be vacuumed, pushing or pulling a vacuum release lever as required for safety and alternately for releasing large debris from a nozzle of a removable suction end, pushing the vacuum release lever to plug at least one orifice to return vacuum to the nozzle of the removable suction end, releasing a vacuum hose securer to remove the vacuum hose handling assembly from a vacuum hose, and storing the vacuum hose handling assembly.

The present invention holds significant improvements and serves as a vacuum hose handling and safety vacuum release system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, vacuum hose handling and safety vacuum release system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an industrial vacuum nozzle device and more particularly to a vacuum hose handling and safety vacuum release system as used to improve the safety and efficiency of operating such a device.

Figure 1:
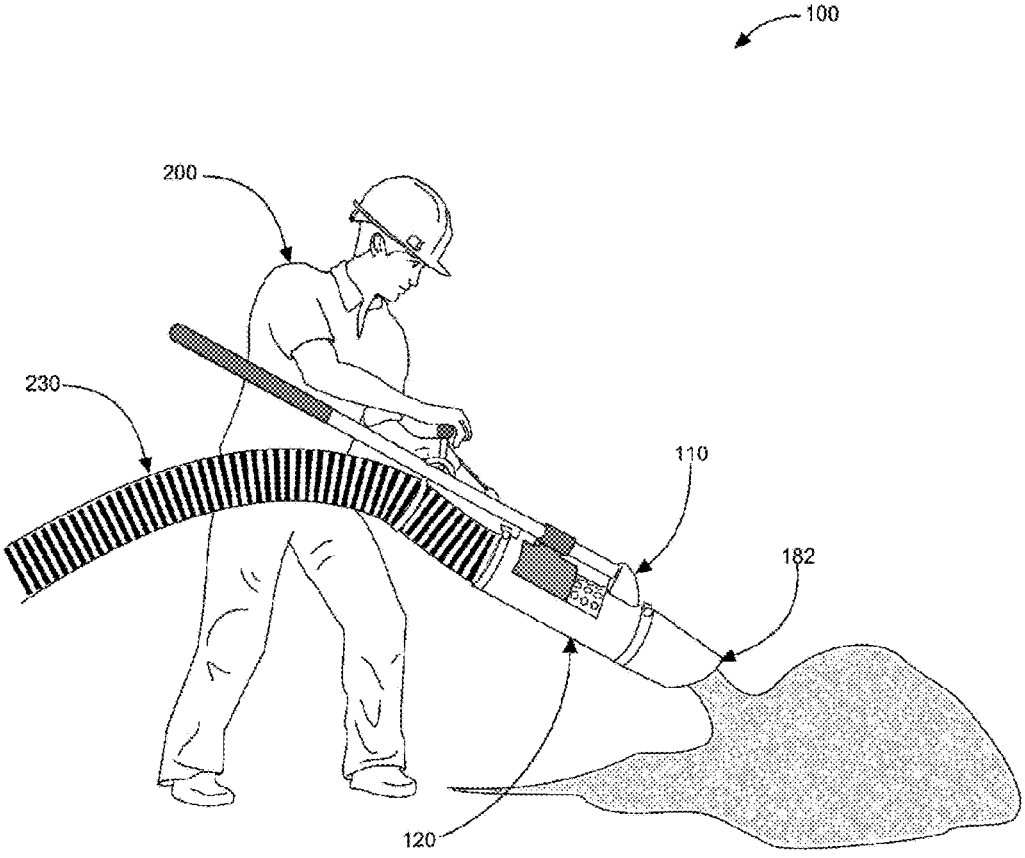
FIG. 1 shows a perspective view illustrating an in-use condition of a vacuum hose handling and safety vacuum release system according to an embodiment of the present invention.

In greater detail now, referring to the drawings by numerals of reference there is shown in FIG. 1, a perspective view illustrating an in-use condition of vacuum hose handling and safety vacuum release system 100 according to an embodiment of the present invention.

Vacuum hose handling and safety vacuum release system 100 comprises vacuum hose handling assembly 110 having column 120 (having proximate end 122 and distal end 124), at least one handle 130 (having first end 132 having grip 140, and second end 134), vacuum release lever 150, vacuum release linkage 160, vacuum release orifice stopper 170, removable suction end 180, and suction end securer band 190. Vacuum hose handling assembly 110 is useful for controllably vacuum-sucking material into vacuum hose 199 connected to a vacuum source, the vacuum controllable by user 200 such as to virtually eliminate any need for user 200 to manually extract items of material when distal end 124 of column 120 becomes clogged. Other mechanical and non-mechanical means for providing the equivalent of vacuum release linkage 160 may be used.

Figure 2A:
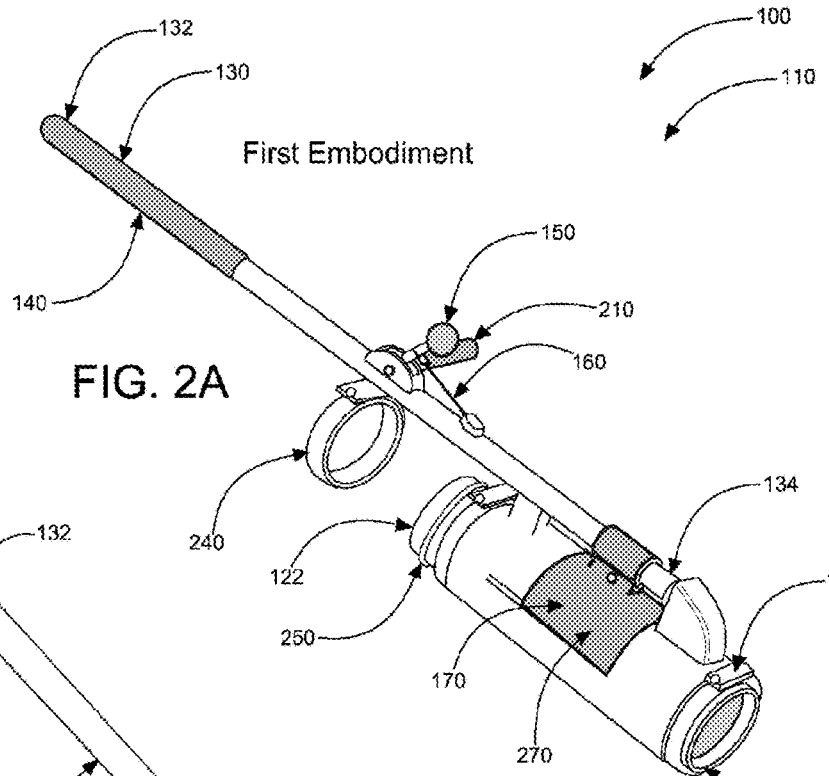
FIGS. 2A and 2B are perspective views illustrating a vacuum hose handling assembly of the vacuum hose handling and safety vacuum release system according to embodiments of the present invention of FIG. 1.
Figure 2B:
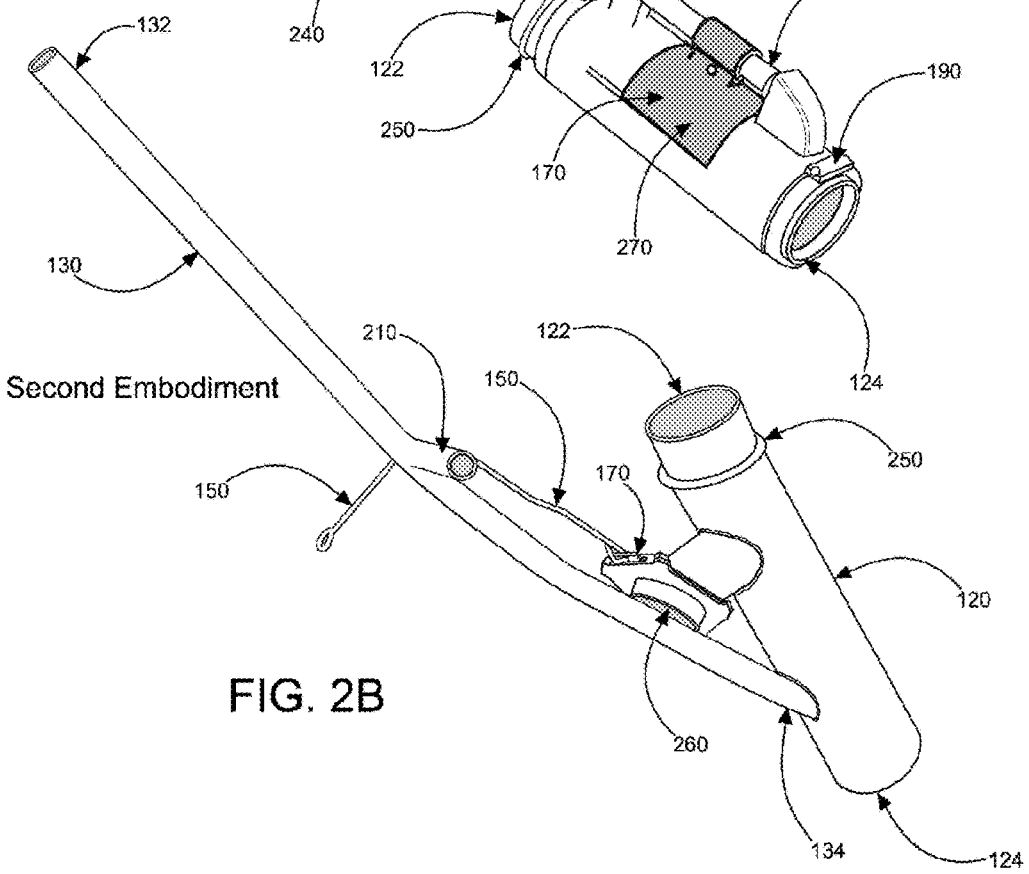

Referring now to FIGS. 2A and 2B, perspective views illustrating vacuum hose handling assembly 110 of vacuum hose handling and safety vacuum release system 100 according to embodiments (first and second respectively) of the present invention of FIG. 1.

Second end 134 of handle 130 is preferably affixed to distal end 124 of column 120 to steady column 120 while in use. Column 120 is tubular in a preferred embodiment but may comprise other cross-sectional shapes in other embodiments. Handle 130 may comprise a contoured-bend along its length to facilitate user 200 standing in a comfortable upright orientation when using vacuum hose handling assembly 110 to remove material from a ground surface. Handle 130 preferably comprises T-handle 210; T-handle 210 is located on an opposite side to vacuum release lever 150 such that vacuum hose handling assembly 110 is balanced when held and manipulated. Vacuum release lever 150 rotates about a centerline axis perpendicular to handle 130, vacuum release linkage 160 running substantially parallel to handle 130.

Figure 3:
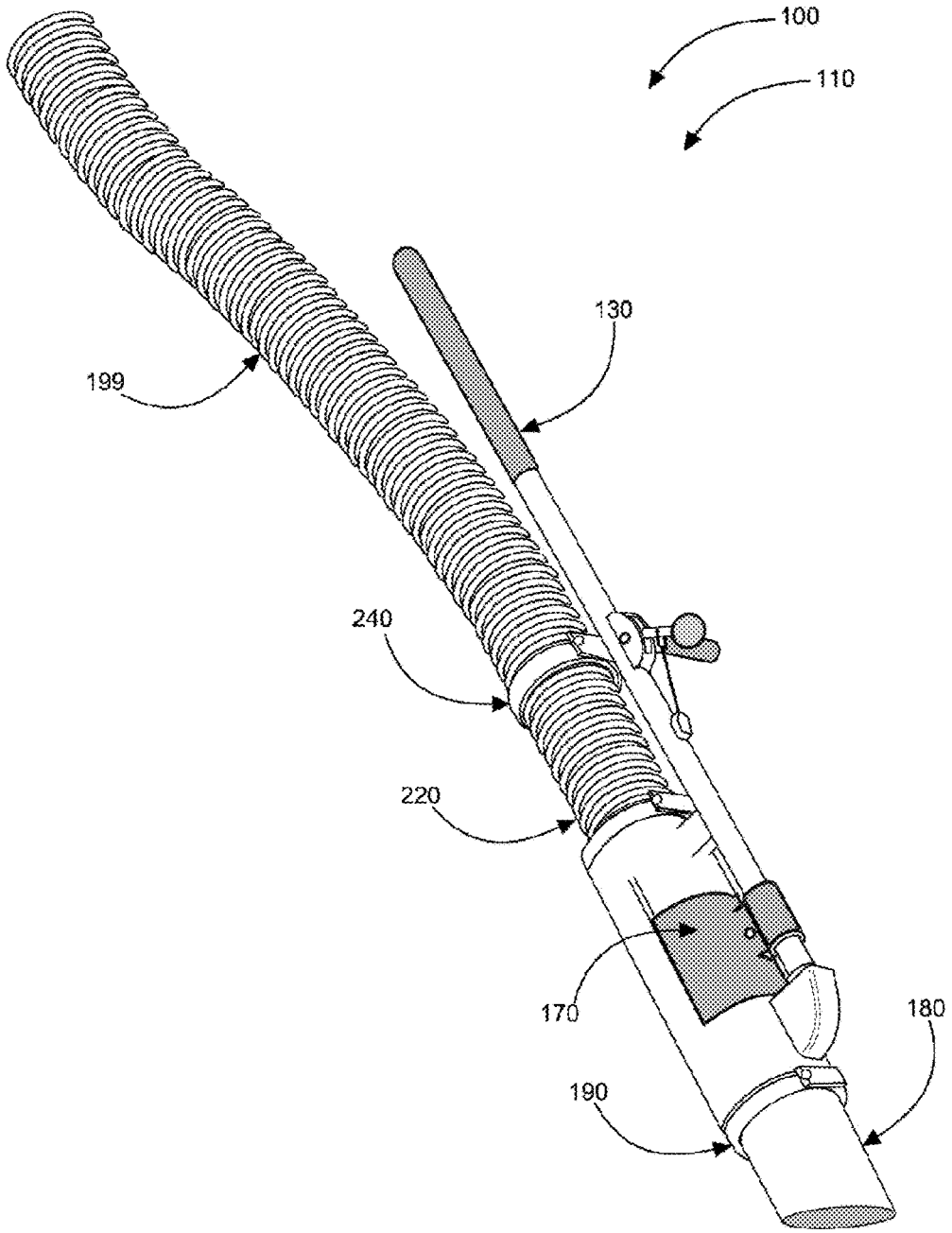
FIG. 3 is a perspective view illustrating an installed condition of the vacuum hose handling and safety vacuum release system according to an embodiment of the present invention of FIG. 1.

Referring now to FIG. 3, a perspective view illustrating an installed condition of vacuum hose handling and safety vacuum release system 100 according to an embodiment of the present invention of FIG. 1.

Proximate end 122 of column 120 of vacuum hose handling assembly 110 is removably attached to vacuum hose end 220 of a vacuum source. Handle 130 is removably attached longitudinally to an exterior of column 120 such that first end 132 of handle 130 comprising grip 140 is adjacent flexible vacuum hose 230; grip 140 providing a gripper for user to hold and manipulate vacuum hose handling assembly 110 from proximate end 122. Vacuum hose securer 240 may comprise a clamp (suitable fastening means) for securing flexible vacuum hose 230 to proximate end 122 of column 120. Column 120 preferably comprises a taper to prevent vacuum hose end 220 from becoming plugged by oversized pieces of material. Taper comprises a larger circumference at proximate end 122 than at distal end 124 of column 120 in those particular embodiments. Proximate end 122 of column 120 comprises landing 250 such that vacuum hose 199 is only able to be inserted over proximate end 122 of column 120 a specified distance.

Figure 4:
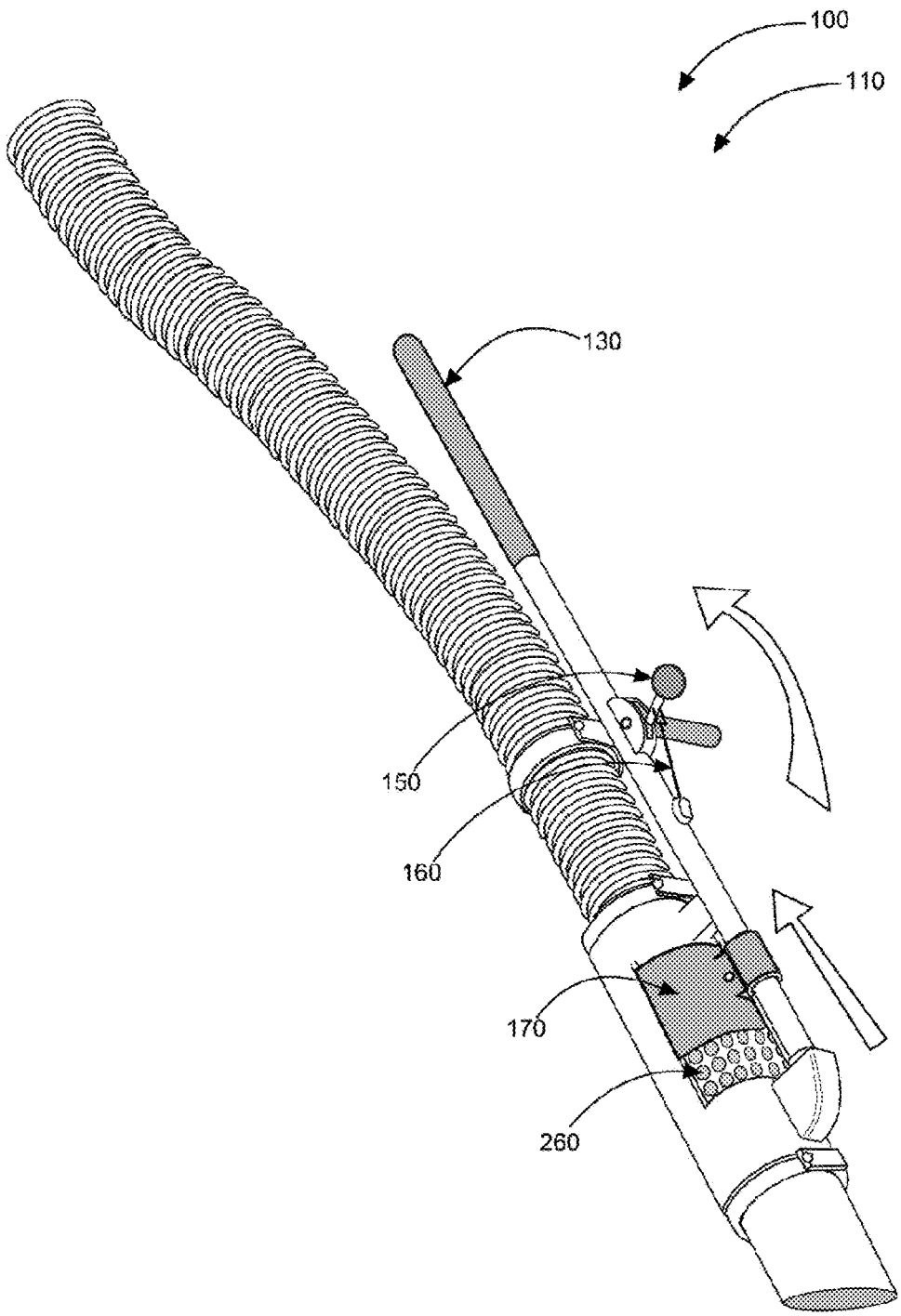
FIG. 4 is a perspective view illustrating a vacuum safety bypass position of the vacuum hose handling and safety vacuum release system according to an embodiment of the present invention of FIG. 1.

Referring now to FIG. 4, a perspective view illustrating vacuum safety bypass position of vacuum hose handling and safety vacuum release system 100 according to an embodiment of the present invention of FIG. 1.

Vacuum release lever 150 is preferably connected to vacuum release orifice stopper 170 via vacuum release linkage 160; vacuum release linkage 160 is able to move vacuum release orifice stopper 170 between open and closed positions in relation to column 120 to provide vacuum and alternately to release vacuum. Vacuum release orifice stopper 170 maintains a vacuum in column 120 (enclosed volume) when closed and allows airflow and releases the vacuum when opened, vacuum release orifice stopper 170 slidably covers at least one orifice 260 located in column 120. Vacuum release lever 150 comprises a safety-release-handle. The safety-release-handle can regulate air flow and vacuum via vacuum release linkage 160. The safety-release-handle comprises an open condition for vacuum release orifice stopper 170 when in a rearward location. In this way the operator is able to safely operate the present invention.

The safety-release-handle comprises a closed condition for vacuum release orifice stopper 170 when safety-release-handle is in a forward location (as shown in FIG. 3). Vacuum release linkage 160 comprises a rigid rod such that vacuum release lever 150 is able to push or pull vacuum release orifice stopper 170 into an open condition. Vacuum release linkage 160 is thereby also able to push vacuum release orifice stopper 170 to close at least one orifice 260 located in column 120 in closed condition. Vacuum release lever 150 may comprise a cable (or other suitable means such as a rigid rod) in other embodiments. Vacuum release orifice stopper 170 may comprises a planar gate valve to plug a single orifice 260 in a lateral tube extending at a right angle to column 120, or may comprise an arcuate slide cover 270 to cover at least one orifice 260 in column 120. It should be appreciated that other means for restricting vacuum and actuating it may be employed such as doors, other linking means and the like. The various components may be sized and shaped differently. Other securing means to the vacuum source may be used. Various handle configurations may be employed and still be considered within the scope of the present invention.

Figure 5:
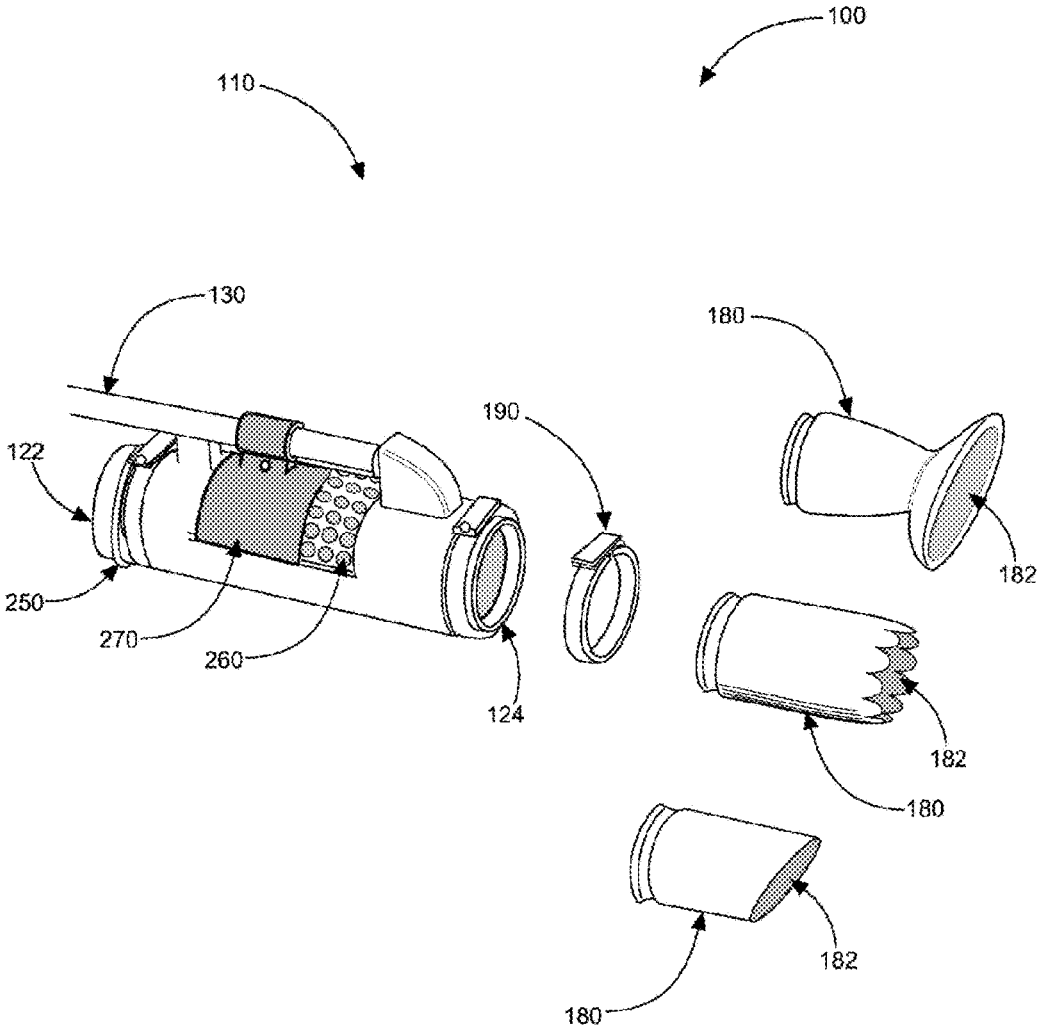
FIG. 5 is a perspective view illustrating variously shaped replaceable nozzles of the vacuum hose handling and safety vacuum release system according to an embodiment of the present invention of FIG. 1.

Referring now to FIG. 5, a perspective view illustrating variously shaped removable suction end(s) 180 of vacuum hose handling and safety vacuum release system 100 according to an embodiment of the present invention of FIG. 1. Removable suction end 180 is removably coupleable to distal end 124 of column 120 via suction end securer band 190. Variously shaped geometrical designs may characterize nozzle end 182 of auxiliary removable suction end(s) 180 to facilitate the suctioning of different types and sizes of materials from variously shaped containments.

Figure 6:
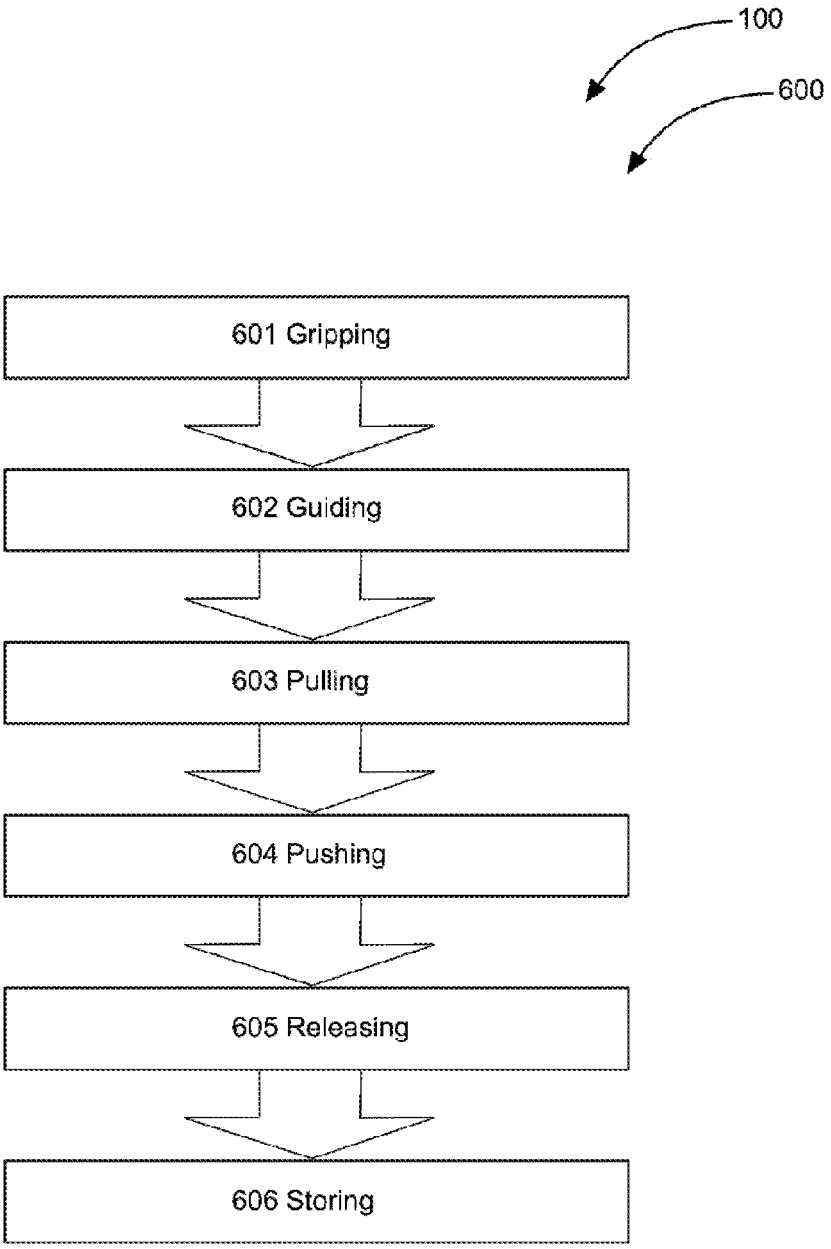
FIG. 6 is a flowchart illustrating a method of use of the vacuum hose handling and safety vacuum release system according to an embodiment of the present invention of FIGS. 1-5.

Referring now to FIG. 6, is a flowchart illustrating method of use 600 of vacuum hose handling and safety vacuum release system 100 according to an embodiment of the present invention of FIGS. 1-5.

Referring now to FIG. 6, showing a flowchart illustrating method of use 600 for vacuum hose handling and safety vacuum release system 100 according to an embodiment of the present invention of FIGS. 1-5. A method of use 600 for vacuum hose handling and safety vacuum release system 100 may comprise the steps of: step one 601 gripping handle 130 and T-handle 210 of vacuum hose handling assembly 110; step two 602 guiding vacuum hose handling assembly 110 to a debris to be vacuumed; step three 603 (pushing or) pulling vacuum release lever 150 as required for safety and alternately for releasing large debris from nozzle end 182 of removable suction end(s) 180; step four 604 pushing vacuum release lever 150 to plug at least one orifice 260 to return vacuum to nozzle end 182 of removable suction end(s) 180; step five 605 releasing vacuum hose securer 240 to vacuum hose handling assembly 110 from vacuum hose 199; and step six 606 storing vacuum hose handling assembly 110.

It should be noted that step 606 is an optional step and may not be implemented in all cases. Optional steps of method 600 are illustrated using dotted lines in FIG. 6 so as to distinguish them from the other steps of method 600.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

Figure 7:
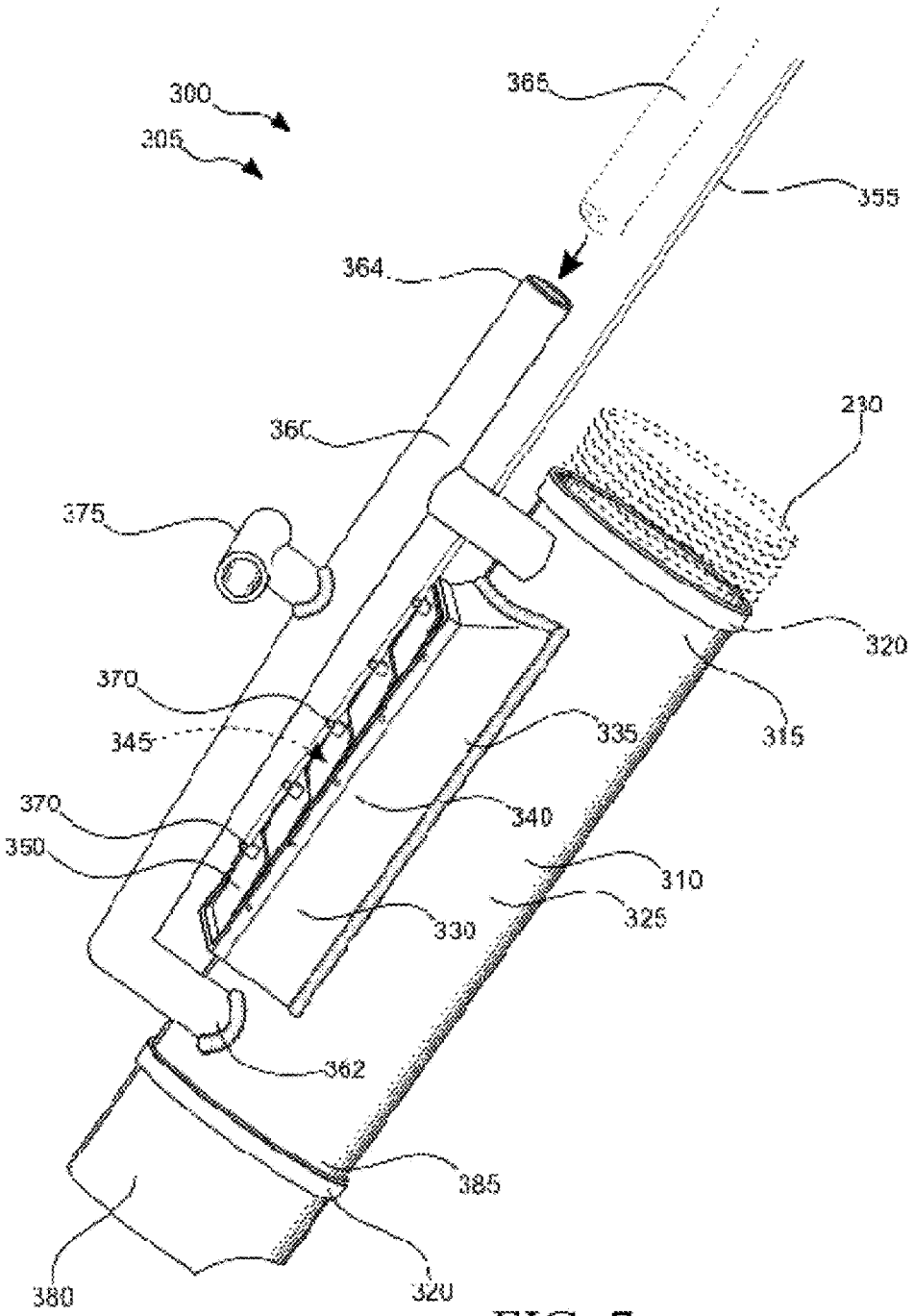
FIG. 7 is a perspective view illustrating a preferred embodiment of vacuum hose suction tube and vacuum release apparatus according to an embodiment of the present invention of FIG. 1.

Referring now to FIG. 7, showing a perspective view illustrating a preferred embodiment of vacuum hose suction tube and vacuum release apparatus 300 according to an embodiment of the present invention of FIG. 1.

Vacuum hose suction tube and vacuum release apparatus 300 preferably comprises vacuum hose suction tube assembly 305 having main column 310 with hose connection-end 315 having hose connection clamp 320, implement attachment-end having hose connection clamp 320, center portion 325, louver box 330 having base side 335 and louver side 340, vacuum diversion opening 345, plurality of louvers 350 each having a plurality of vacuum diversion lever couplers 370, vacuum diversion lever 355, control handle 360 having extension handle 365 and at least one t-handle 375, and a plurality of removable suction implements 380.

Vacuum hose suction tube assembly 305 is useful for controllably vacuum-sucking material into vacuum hose 199 connected to a vacuum source with greater control by user 200 and to virtually eliminate the need for user 200 having to manually extract lodged objects from implement attachment-end 385 of vacuum hose suction tube assembly 305 by diverting the vacuum through louvers 350 on the sidewall of main column 310. Hose connection-end 315 is structured to couple to vacuum hose connection-end 315 of vacuum hose 199 via a single hose connection clamp 320. Implement attachment-end 385 of main column 310 is structured and arranged to couple to any of the removable suction implements 380. Main column 310 comprises a tube having center portion 325 located between hose connection-end 315 and implement attachment-end 385.

Center portion 325 of main column 310 comprises vacuum diversion opening 345 with a size that is at least as large as the inside diameter of main column 310 so that the vacuum can be diverted from implement attachment-end 385. Base side 335 of louver box 330 is non-removably attached to main column 310 about vacuum diversion opening 345 so that the attachment between the two is airtight. The plurality of louvers 350 are pivotally spaced and attached to louver side 340 of louver box 330 such that they are able to be pivoted to close or to open vacuum diversion opening 345. Each of vacuum diversion lever couplers 370 are structured and arranged to non-removably attach to the plurality of louvers 350 and to vacuum diversion lever 355 such that pushing or pulling vacuum diversion lever 355 rotatably opens the plurality of louvers 350 to allow the air suction source to be diverted away from implement attachment-end 385 and through vacuum diversion opening 345, or pushing vacuum diversion lever 355 to rotatably close louvers 350 to re-route the vacuum to implement attachment-end 385.

Attachment end 362 of control handle 360 is non-removably attached to main column 310 near implement attachment-end 385 and positioned longitudinally along main column 310, control handle 360 comprising coupleable end 364 opposite attachment end 362. Extension handle 365 is able to be threadably coupled (or pinned) to attachment end 362 of control handle 360 to extend graspable portion of control handle 360. Grasp-handle(s) 375 is/are non-removably and perpendicularly attached to control handle 360 such that user 200 is able to more easily manipulate vacuum hose suction tube assembly 305 to suction debris.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A vacuum hose suction tube and vacuum release apparatus comprising:

a vacuum hose suction tube assembly having;

a main column having a hose connection-end, an implement attachment-end, and a center portion comprising;

at least one hose connection clamp;

a louver box having a base side and a louver side;

a vacuum diversion opening;

a plurality of louvers each having;

a plurality of vacuum diversion lever couplers;

a control handle having an extension handle and at least one t-handle;

a vacuum diversion lever; and a plurality of removable suction implements;

wherein said vacuum hose suction tube assembly comprises a means for a user to conveniently control a vacuum hose connection end of a vacuum hose and for said user to divert an air suction of a vacuum source to remove a suction attached end of said vacuum hose suction tube assembly from a vacuum attached object that is larger than a diameter of said main column of said vacuum hose suction tube assembly;

wherein said hose connection-end is structured to couple to said vacuum hose connection end of said vacuum hose via a single said hose connection clamp;

wherein said implement attachment-end of said main column is structured and arranged to couple to said plurality of removable suction implements;

wherein said main column comprises a tube and said center portion of said tube is located between said hose connection-end and said attachment-end;

wherein said center portion of said main column comprises said vacuum diversion opening having a size at least as large as an inside diameter of said main column;

wherein said base side of said louver box is non-removably attached to said main column about said vacuum diversion opening;

wherein said plurality of louvers are pivotally spaced and attached to said louver side of said louver box such that said plurality of louvers are able to be pivoted to close said vacuum diversion opening;

wherein each of said plurality of vacuum diversion lever couplers are structured and arranged to non-removably attach to said plurality of louvers and to said vacuum diversion lever such that pushing said vacuum diversion lever rotatably opens said plurality of louvers to allow said air suction of said vacuum source to be diverted away from said implement attachment-end and through said vacuum diversion opening;

wherein an attachment end of said control handle is non-removably attached to said main column near said implement attachment-end and positioned longitudinally along said main column, said control handle comprising a coupleable end opposite said attachment end;

wherein said extension handle is structured and arranged to pin couple to said attachment end of said control handle to extend a graspable portion of said control handle;

wherein said at least one t-handle is non-removably and perpendicularly attached to said control handle such that said user is able to more easily manipulate said vacuum hose suction tube assembly to suction debris; and wherein said vacuum hose suction tube assembly is useful for controllably vacuum-sucking material into said vacuum hose connected to said vacuum source.

* * * * *